US006646242B2

(12) United States Patent
Berry et al.

(10) Patent No.: US 6,646,242 B2
(45) Date of Patent: Nov. 11, 2003

(54) ROTATIONAL CANTED-JOINT MISSILE CONTROL SYSTEM

(75) Inventors: Roger P. Berry, Huntsville, AL (US); Daniel F. Lawless, Hazel Green, AL (US); Stephen C. Cayson, Huntsville, AL (US); Lamar M. Auman, Union Grove, AL (US); J. C. Dunaway, Falkville, AL (US); Mark D. Dixon, Huntsville, AL (US); David A. Gibson, Fayetteville, TN (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 53 days.

(21) Appl. No.: 10/083,518

(22) Filed: Feb. 25, 2002

(65) Prior Publication Data

US 2003/0160129 A1 Aug. 28, 2003

(51) Int. Cl.[7] ..... F42B 10/26
(52) U.S. Cl. ..... 244/3.1; 244/3.23
(58) Field of Search ..... 244/3.1, 3.23, 244/3.28, 3.29, 3.21

(56) References Cited

U.S. PATENT DOCUMENTS

| | | | | | |
|---|---|---|---|---|---|
| 3,433,439 | A | * | 3/1969 | Brame et al. | 244/120 |
| 4,399,962 | A | * | 8/1983 | Wedertz et al. | 244/3.23 |
| 4,579,298 | A | * | 4/1986 | Thomson | 244/3.21 |
| 4,925,130 | A | * | 5/1990 | Kranz | 244/3.21 |
| 5,139,216 | A | * | 8/1992 | Larkin | 244/3.21 |
| 5,564,651 | A | * | 10/1996 | Wiemer et al. | 244/3.21 |
| 6,116,537 | A | * | 9/2000 | Kempas | 244/3.16 |
| 6,364,248 | B1 | * | 4/2002 | Spate et al. | 244/3.23 |

* cited by examiner

*Primary Examiner*—Charles T. Jordan
*Assistant Examiner*—Stephen Holzen
(74) *Attorney, Agent, or Firm*—Arthur H. Tischer; Dayn T. Beam; Hay Kyung Chang

(57) ABSTRACT

The Rotational Canted-Joint Missile (RCJM) Control System utilizes a single or multiple body joints that rotate in planes that are not perpendicular to the missile body axis. The result is the deflection of a portion of the missile body for flight control purposes. The canted interface plane between any two adjacent movable sections of the missile body and a joint at the interface plane that allows one of the sections to be rotated by a pre-determined angle with respect to the other section comprise a rotational plane mechanism that offers an inclined bearing plane with a large mechanical advantage over typical "brute force" ball joint methods.

7 Claims, 3 Drawing Sheets

ROTATIONAL CANTED-JOINT MISSILE CONTROL SYSTEM

DEDICATORY CLAUSE

The invention described herein may be manufactured, used and licensed by or for the Government for governmental purposes without the payment to us of any royalties thereon.

BACKGROUND OF THE INVENTION

Historically, missile flight direction control has been achieved by using thrust vector control (TVC), jet reaction control (JRC), canard control or tail fin control. However, each of these control methods has significant disadvantages. For example, even though TVC systems provide high controllability with minimal drag force, they are only effective during the boost portion of the flight. JRC systems can provide control during the entire flight and also have very low drag, but are limited by the amount of propellant that can be packed into the missile. Canard and tail fin controls enable excellent controllability provided that the missile velocity is sufficient. The disadvantage here is that canard and tail fin control systems can result in excessive drag.

Another potential means of controlling the missile flight direction is a system involving the manipulation of the forward section of the missile or the nosecone. However, normally such a system requires a large amount of power to actuate the forward section.

SUMMARY OF THE INVENTION

The Rotational Canted-Joint Missile (RCJM) Control System reduces the actuation force requirement significantly by decoupling the nosecone lift force from the actuation force through a low friction joint. Utilizing a single or multiple body joints that rotate in planes that are not perpendicular to the missile body axis, the RCJM Control System deflects a portion of the missile body for flight control purposes. The canted interface plane between any two adjacent sections of the missile body and a joint at the interface plane that allows one of the sections to be rotated by a pre-determined angle with respect to the other section comprise a rotational plane mechanism that offers an inclined bearing plane with a large mechanical advantage over typical "brute force" ball joint methods.

DESCRIPTION OF THE PREFERRED EMBODIMENT

Figure 1:
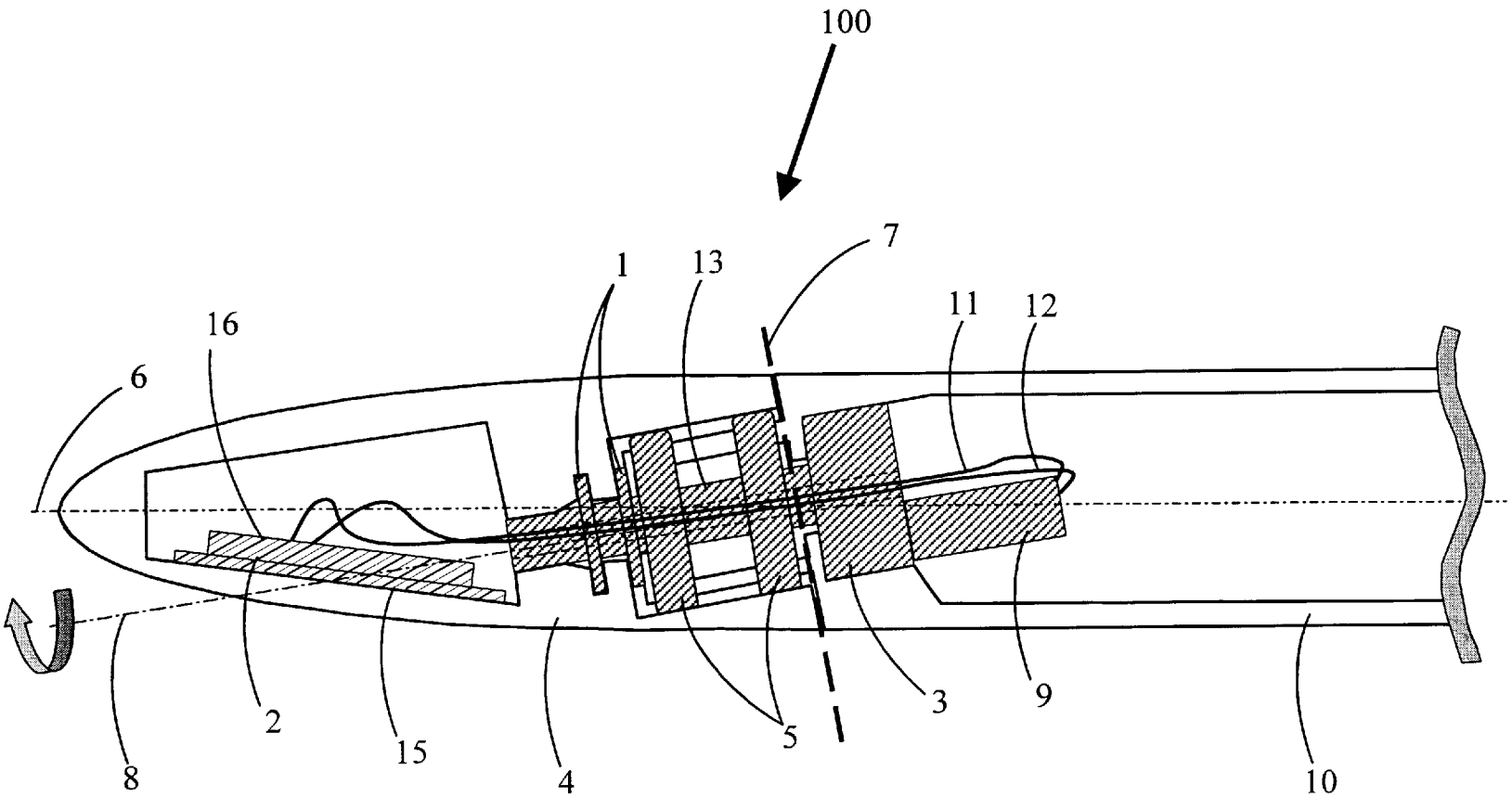
FIG. 1 is a cross-sectional view of the Rotational Canted-Joint Missile (RCJM) Control System using a single joint.
Figure 3:
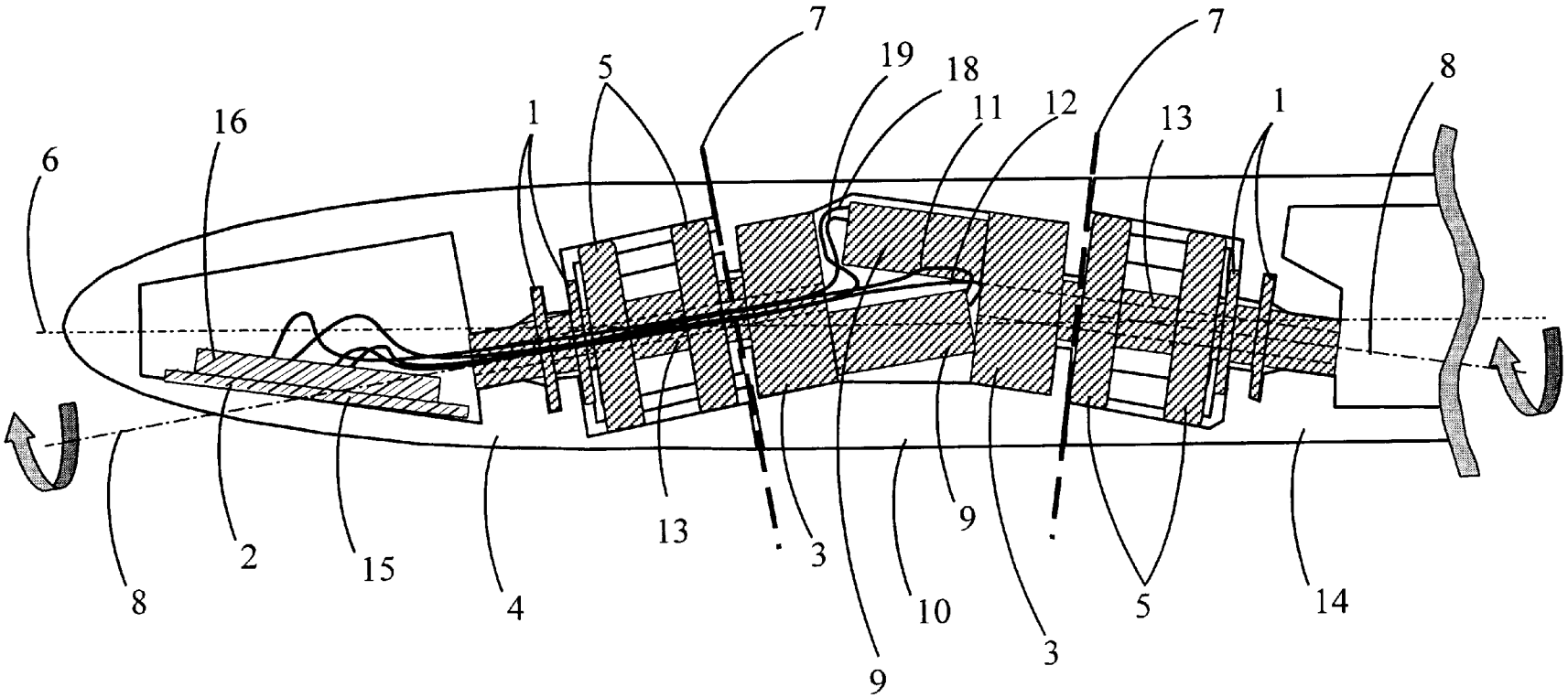
FIG. 3 presents a cross-sectional view of the Rotational Canted-Joint Missile (RCJM) Control System using multiple joints within the same missile.

Referring now to the drawing wherein like numbers represent like parts in each of the several figures, FIG. 1 shows a single canted-joint system that connects first section 4 and second section 10 of missile 100. The sections meet at canted interface plane 7 which intersects missile axis 6 at a slight angle in the 0.50° to 10° range depending on the requirements of the missile being controlled. For multiple canted-joint systems such as illustrated in FIG. 3, interface planes 7 are typically 90° to 180° out of phase with each other in order to gain additional axes of control. In this configuration, the double canted-joint system connects first section 4 to second section 10 and finally second section 10 to third section 14 utilizing two separate canted-joint systems.

Figure 2:
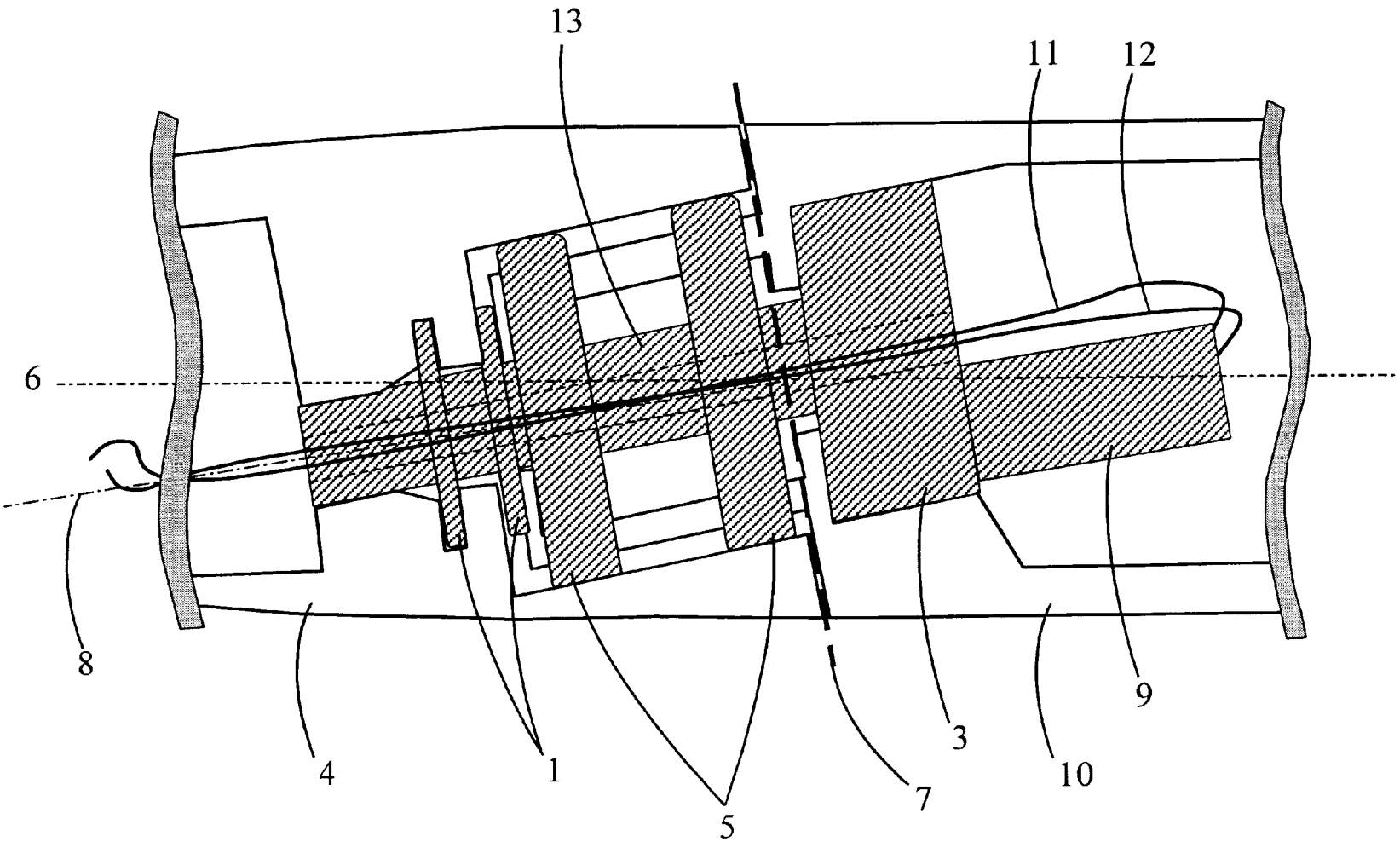
FIG. 2 illustrates the joint in detail.

FIG. 2 presents a detailed view of the canted-joint which is comprised of drive shaft 13 that extends between first section 4 and second section 10 and is rigidly attached to the first section while being movably coupled to drive 3 in the second section. The drive itself, which may be a harmonic drive, is rigidly affixed to the second section. Mounted on the drive shaft are thrust bearings 1 and roller bearings 5 within the first section. They provide axial support and radial support, respectively, to the canted-joint system during missile flight and acceleration.

The operation of the Rotational Canted-Joint Missile (RCJM) Control System is described below in detail, including the function of a typical canted-joint. The description applies equally to any number of joints that may be employed in a missile.

Initially, an electrical command signal is generated by and sent from position command generator 15 to electronic controller 2, which also receives the current rotational position information from motor 9 via first signal paths 11 (and 18, if two joints are employed). The hall sensors located within the motor derive the current rotational position information by counting the hall pulses generated by the motor. The hall pulse counting is a method which tracks the rotational position of the missile by counting hall pulses as the motor stator rotates and mathematically computing the total missile position based on the addition and subtraction of these hall pulses. Even though the current rotational position can be determined absolutely through other means such as potentiometer devices, the hall pulse counting method has the advantage of being able to comply with the space and weight constraints of a missile. It is noted, however, that this hall pulse counting method necessitates an initialization of the missile at the "zero" position to which all other determined positions would be relative.

Electronic controller 2, then, compares the command signals with the current rotational position signals and generates any error signals as a result. The error signals are input to voltage generator 16 which, in response, generates proportional voltage commands that are transmitted via second signal paths 12 (and 19, if two joints are employed) to motor 9 to power the motor. A clockwise error signal results in a voltage command that energizes the motor ultimately to deliver the torque which rotates the joint through drive shaft 13. The rotational force from the motor, drive and the drive shaft causes first section 4 of missile 100 to rotate about missile axis 6 relative to second section 10 in one direction until the error signal is eliminated. A counter-clockwise error signal results in a voltage command that energizes the motor to drive the first section in the opposite direction. Again, the rotation is continued until the error signal is reduced to zero. If the comparison of the command signals and the current rotational position signals yields zero error, the driving mechanism is not energized.

The rotation of first missile section 4 about joint plane axis 8 that is perpendicular to interface plane 7 results in an angular displacement of missile axis 6. This angular displacement or tilt of the first section relative to the remainder of the missile fuselage causes a non-symmetric airflow over the missile that produces an imbalance in the aerodynamic force and moment on the missile. The aerodynamic force and moment imbalance is primarily effective in one direction lateral to the missile axis, causing the missile flight path to be changed. The missile rotates about its center-of-gravity until the moment imbalance is nullified. A deflection of the first missile section ranging from 0° to 5° produces trim normal force coefficients that range from 0 to 0.7.

As shown in FIG. 3, a second joint may be employed in the missile to cause an aerodynamic force that is primarily effective in another direction lateral to the missile axis and perpendicular to the force caused by the first joint. In this manner, the missile flight path can be changed in two independent directions simultaneously, such as pitch and yaw.

The speed and actuation force required depend upon the control requirements of the missile and the rotational inertia of the missile section being controlled. The acceleration of the missile applies a reactionary rotational force tangential to the incline of the control plane that must be overcome by the control driving mechanism. Further, additional forces are encountered as bending moments are resisted through the joint due to missile body lift as well as the inertial loads encountered through the repositioning process. The advantage of the Rotational Canted-Joint Missile (RCJM) Control System is that the larger component of both the acceleration and lift loads are resisted by the bearings while the much smaller tangential and inertial loads are those that are manipulated for flight path control purposes.

Although a particular embodiment and form of this invention has been illustrated, it is apparent that various modifications and embodiments of the invention may be made by those skilled in the art without departing from the scope and spirit of the foregoing disclosure. Accordingly, the scope of the invention should be limited only by the claims appended hereto.

We claim:

1. A system for guiding the flight of a missile in any given direction, the missile having an elongated body and a longitudinal axis; a first movable section and a second movable section; an interface plane positioned between the sections and intersecting the axis at an angle between 0.5° and 10°; the missile further having a position command generator and a voltage generator; SAID MISSILE GUIDING SYSTEM comprising: a rotatable joint, said joint coupling the first and second movable sections so as to allow rotation of the first section by a pre-selected angle with respect to the second section, said rotatable joint comprising: a drive shaft rigidly attached to the first section and movably attached to the second section, said shaft connecting the sections and being mounted to be perpendicular to the interface plane; a plurality of thrust bearings located in the first section and mounted on said drive shaft, said thrust bearings providing axial support to said guiding system during missile flight; a plurality of roller bearings located in the first section and mounted on said drive shaft, said roller bearings providing radial support to said guiding system during missile flight, said thrust bearings and roller bearings being positioned adjacent to each other; a means for rotating said joint; a means for determining current rotational position of the missile; an electronic controller containing therein a hall pulse counting circuit, said controller being connected to the position command generator and said determining means to receive command signals and current rotational signals, respectively, therefrom and yield error signals in response thereto; a voltage generator coupled between said electronic controller and said rotating means, said voltage generator receiving said error signals from said controller and, in response, generating a proportional voltage command, said voltage command being input to said rotating means to cause the rotation of said joint by a corresponding angle, thereby rotating the first section with respect to the second section, thus effecting a chance in the flight direction of the missile.

2. A system for guiding the flight of a missile in any given direction as set forth in claim 1, wherein said means for rotating said joint comprises: a drive located within the second section, said drive movably supporting said drive shaft; and a motor coupled to said drive, said motor having therein hall sensors for deriving current rotational position of the missile; a first signal path between said motor and said electronic controller for transmission of current rotational position signals from said motor to said controller; and a second signal path between said voltage generator and said motor to transmit said proportional voltage command from said voltage generator to said motor so as to energize said motor accordingly.

3. A system for guiding the flight of a missile as set forth in claim 2, wherein said drive is rigidly mounted within the second section.

4. A system for guiding the flight of a missile in any given direction, the missile having an elongated body with an axis and a position command generator, the missile body comprising at least three movable sections with an interface plane between any two adjacent sections, said guiding system comprising: at least two rotatable joints, each of said joints coupling any two adjacent movable sections so as to allow one of said sections to rotate by a pre-selected angle with respect to the other section, each of said joint comprising: a drive shaft rigidly attached to one of any two adjacent sections while connecting said two sections, a pair of thrust bearings located in one section and mounted on said drive shaft, said thrust bearings providing axial support to said guiding system during missile flight, a pair of roller bearings located adjacent to said thrust bearings within the same section as said thrust bearings and mounted on said drive shaft, said roller bearings providing radial support to said guiding system during missile flight; a means for rotating each of said joints; a means for determining current rotational position of said missile; an electronic controller, said controller being connected to said position command generator and said determining means to receive command signals and current rotational position signals, respectively, therefrom and respond to yield error signals; a voltage generator coupled between said electronic controller and said rotating means, said voltage generator receiving said error signals from said controller and, in response, generating proportional voltage commands, said voltage commands being input to said rotating means to cause the rotation of at least one of said jointed sections by an angle corresponding to said voltage commands, thereby effecting a change in the flight direction of said missile.

5. A system for guiding the flight of a missile in any given direction as set forth in claim 4, wherein said interface planes are typically 90° to 180° out of phase with each other so as to provide additional axes of control during guidance of said missile.

6. In a missile having a longitudinal axis and a position command generator, at least a first movable section and a second movable section with an interface plane between the sections, the missile further having an electronic controller for yielding error signals and a voltage generator for generating a voltage command corresponding to the error signals; a rotational canted-joint system for guiding the flight direction of the missile, said canted-joint system comprising: a rotatable joint, said joint coupling the first and the second movable sections so as to allow rotation of the first section by a pre-selected angle with respect to the second section, said joint comprising a drive shaft rigidly attached to the first section and movably attached to the second section, said shaft connecting the sections and being mounted to be perpendicular to the interface plane, a plurality of thrust bearings located in the first section and mounted on said drive shaft, said thrust bearings providing axial support to said canted-joint system during missile flight, a plurality of roller bearings located in the first section and mounted on said drive shaft, said roller bearings providing radial support to said canted-joint system during missile flight, said thrust bearings and roller bearings being positioned adjacent to each other; and a means for rotating said joint, said rotating means being coupled to receive the voltage command from the voltage generator and, in response, cause the rotation of the first section with respect to the second section, thus effecting a change in the flight direction of the missile.

7. A rotational canted-joint system for guiding the flight direction of a missile as set forth in claim 6, wherein said means for rotating said joint comprises: a drive located within the second section, said drive movably supporting said drive shaft; and a motor coupled to said drive, said motor having therein hall sensors for deriving current rotational position of the missile; a first signal path between said motor and the electronic controller for transmission of current rotational position signals from said motor to the controller; and a second signal path between the voltage generator and said motor to transmit said proportional voltage command from the voltage generator to said motor so as to motivate said motor accordingly.

* * * * *